US005297879A

United States Patent [19]

Oikawa

[11] Patent Number: 5,297,879

[45] Date of Patent: Mar. 29, 1994

[54] MECHANISM FOR PREVENTING SLACK IN PRINTER CARBON RIBBON

[75] Inventor: Tadahisa Oikawa, Iwate, Japan

[73] Assignee: Kabushiki Kaisha Sato, Japan

[21] Appl. No.: 47,820

[22] Filed: Apr. 15, 1993

[30] Foreign Application Priority Data

Apr. 27, 1992 [JP] Japan ..... 4-131350

[51] Int. Cl.[5] ..... B41J 31/14

[52] U.S. Cl. ..... 400/234; 242/75

[58] Field of Search ..... 400/223, 225, 227, 230, 400/234, 236, 236.2, 120, 208; 242/79, 75.3

[56] References Cited

U.S. PATENT DOCUMENTS

| | | | |
|---|---|---|---|
| 4,591,879 | 5/1986 | Yokota et al. | 400/234 |
| 4,767,228 | 8/1988 | Harry | 400/234 |
| 4,812,063 | 3/1989 | Kunimitsu et al. | 400/234 |

FOREIGN PATENT DOCUMENTS

| | | | |
|---|---|---|---|
| 0197267 | 9/1986 | Japan | 400/234 |
| 0082061 | 4/1987 | Japan | 400/234 |
| 0111773 | 5/1987 | Japan | 400/234 |
| 0055180 | 2/1990 | Japan | 400/234 |
| 3227684 | 10/1991 | Japan | 400/234 |

OTHER PUBLICATIONS

"Ribbon Feed for Bidirectional Printer" IBM Tech. Disclosure Bulletin, vol. 23, No. 4, Sep. 1980 pp. 1517-1520.

*Primary Examiner*—Eugene H. Eickholt

*Attorney, Agent, or Firm*—Ostrolenk, Faber, Gerb & Soffen

[57] ABSTRACT

A mechanism for preventing slack in a printer carbon ribbon includes a reverse rotation mechanism for applying a rotational force to the carbon ribbon feed shaft in the reverse direction from that for feeding the carbon ribbon irrespective of the direction in which a label strip or other printable medium is being fed. The reverse rotation mechanism comprises a first reverse rotation sub-mechanism for applying a rotational force to the carbon ribbon feed shaft in the reverse direction from that for feeding the carbon ribbon when the printable medium is being fed in the forward direction and a second reverse rotation sub-mechanism for applying a rotational force to the carbon ribbon feed shaft in the reverse direction from that for feeding the carbon ribbon when the printable medium is being retracted in the reverse direction. The mechanism is particularly applicable where a drive motor is used both to move the printable medium and to take up the printer carbon ribbon. If the direction of the drive motor is reversed to move the printable medium in a reverse direction, the printer carbon ribbon will thus not be provided with slack.

11 Claims, 4 Drawing Sheets

MECHANISM FOR PREVENTING SLACK IN PRINTER CARBON RIBBON

BACKGROUND OF THE INVENTION

1. Field of the Invention

The present invention relates to a mechanism for preventing slack in a printer carbon ribbon, and more particularly to a mechanism for preventing slack in the carbon ribbon of a thermal transfer printer when the printable medium is fed in the reverse direction from that in ordinary printing.

2. Description of the Prior Art

One type of conventional printer using the thermal transfer printing system employs a continuous label strip consisting of a large number of labels provisionally attached to a backing strip via an adhesive layer or a continuous tag strip without an adhesive layer and prints characters on the labels or tags by thermal transfer using a thermal transfer carbon ribbon.

Since the carbon ribbon is extremely thin, it tends to snake or develop slack as it is being fed. This has an adverse effect on printing performance.

Mechanisms for preventing carbon ribbon snaking and slacking are taught by Japanese Patent Public Disclosure Nos. Sho 60(1985)-157,440, Sho 60(1985)-193,683, Sho 60(1985)-204,560 and the like.

Typical of the conventional mechanisms for preventing slack in a printer carbon ribbon is that of Japanese Patent Public Disclosure No. Sho 60(1985-193,683) schematically illustrated in FIG. 3 herein. This is a mechanism by which the rotation of a carbon ribbon take-up shaft during carbon ribbon take-up is applied to a carbon ribbon feed shaft 14 to bias it in the reverse direction from that for feeding the carbon ribbon.

The ordinary conventional printer i shown in the overall schematic view of FIG. 3 comprises a printer frame 2, a feed shaft 6 for a label strip 5 consisting of a backing strip 3 having a large number of labels 4 (the printable media) provisionally attached thereon, a printing mechanism 9 having a thermal printing head 7 and a platen 8, a peel-off mechanism 11 having a peel-off plate 10, a backing sheet take-up shaft 12, a ribbon feed shaft 14 for a thermal transfer carbon ribbon 13, a carbon ribbon take-up shaft 15, a drive motor 16, a label strip sensor 17, and a carbon ribbon sensor 18.

The drive motor 16 provides the power for feeding the label strip 5 from the feed shaft 6 and the thermal transfer carbon ribbon 13 from the carbon ribbon feed shaft 14. The labels 4 on the backing strip 3 are printed with prescribed characters by supplying the thermal printing head 7 with printing signals.

The printed label strip 5 passes to the peel-off mechanism 11 where only its backing strip 3 is turned sharply at the peel-off plate 10 so as to peel the labels 4 off the backing strip 3.

The backing strip 3 removed of the labels 4 is taken up by the backing sheet take-up shaft 12 and the thermal transfer carbon ribbon 13 is taken up by the carbon ribbon take-up shaft 15.

A reverse rotation mechanism 19 is provided between the carbon ribbon feed shaft 14 and the carbon ribbon take-up shaft 15 for applying the rotation of the carbon ribbon take-up shaft 15 during take-up of the carbon ribbon 13 to the carbon ribbon feed shaft 14 to bias it in the reverse direction from that for feeding the carbon ribbon.

More specifically, a coil spring belt 22 (a coil spring formed into an endless belt) is fitted on a pulley 20 of the carbon ribbon feed shaft 14 and a pulley 21 of the carbon ribbon take-up shaft 15, whereby the rotation of the carbon ribbon take-up shaft 15 when it is driven to take up the carbon ribbon 13 is applied to the carbon ribbon feed shaft 14 in the reverse direction from that for feeding out the carbon ribbon 13.

So as to ensure that the carbon ribbon feed shaft 14 will be able to rotate in the direction for feeding the carbon ribbon 13 notwithstanding the application of the reverse rotational force thereto, a slip mechanism 23 is provided between the carbon ribbon feed shaft 14 and the pulley.

Since the provision of the reverse rotation mechanism 19 allows the carbon ribbon 13 to be fed toward the printing mechanism 9 while applying a prescribed tensile force to the carbon ribbon 13 by pulling it in the direction opposite to the feed direction, slacking of the carbon ribbon 13 is prevented.

For utilizing the printing area of the labels 4 to the utmost, however, thermal transfer printers for printing labels etc. are sometimes designed so that, as shown in FIG. 4, immediately upon completion of the printing of a given label 4, the label strip 5 is retracted by a distance D in the direction opposite to its forward feed direction for enabling the printing position of the printing mechanism 9 to be located as close as possible to the leading edge of the next label 4.

This leads to a problem because reversing the direction of rotation of the drive motor 16 for achieving the retraction not only retracts the label strip 5 but also retracts the carbon ribbon 13 in the direction of the carbon ribbon feed shaft 14, with the result that slack is produced in the carbon ribbon 13.

Moreover, the reverse rotation mechanism 19, which normally operates to draw the carbon ribbon 13 back in the direction opposite to its feed direction, i.e. in the direction of the retraction, has the opposite effect during retraction of the label strip 5 and, therefore, the carbon ribbon 13 develops even more slack.

In addition, although the sensor 18 for the carbon ribbon 13 can be of an optical type which senses reflected or transmitted light in the case where a black carbon ribbon 13 is used for black printing, it has to be a mechanical sensor such as a limit switch if, as has recently become common, a multi-color ribbon is used, since such a ribbon is difficult to detect optically. However, since such a mechanical sensor cannot properly detect a slack carbon ribbon, the printer is apt to malfunction.

SUMMARY OF THE INVENTION

It is an object of the present invention to solve the foregoing problems.

It is an object of the present invention to provide a mechanism for preventing slack in a printer carbon ribbon which enables a reverse rotational force to be applied to the carbon ribbon feed shaft constantly and stably even when the label strip or other printable medium is temporarily fed in the reverse direction, whereby slacking of the carbon ribbon is prevented at all times.

For achieving this object, the present invention provides a mechanism for preventing slack in a printer carbon ribbon wherein the carbon ribbon feed shaft is always applied with a rotational force acting in the reverse direction to the carbon ribbon feed direction irrespective of the direction of a rotation of the carbon ribbon take-up shaft, the mechanism comprising a printing mechanism having a printing head and a platen for printing characters on a printable medium as the printable medium is fed thereto, a carbon ribbon feed shaft for feeding a carbon ribbon to enable the printing on the printable medium, a carbon ribbon take-up shaft for taking up the carbon ribbon, a slip mechanism provided on the carbon ribbon feed shaft, and a reverse rotation mechanism for applying a rotational force to the carbon ribbon feed shaft in the reverse direction from that for feeding the carbon ribbon, the reverse rotation mechanism having a first reverse rotation sub-mechanism for applying a rotational force to the carbon ribbon feed shaft in the reverse direction from that for feeding the carbon ribbon when the printable medium is being fed in the forward direction and a second reverse rotation sub-mechanism for applying a rotational force to the carbon ribbon feed shaft in the reverse direction from that for feeding the carbon ribbon when the printable medium is being retracted in the reverse direction from the forward direction.

The first reverse rotation sub-mechanism can, for example, be provided so as to transmit the rotational force for taking up the carbon ribbon from the carbon ribbon-take-up shaft to an intermediate shaft and from the intermediate shaft to a first pulley of the carbon ribbon feed shaft.

The second reverse rotation sub-mechanism can, for example, be provided so as to transmit the rotational force for taking up the carbon ribbon from the carbon ribbon take-up shaft to a second pulley of the carbon ribbon feed shaft.

The first and second reverse rotation sub-mechanisms can be driven by a platen drive mechanism for rotating the platen.

In the mechanism for preventing slack in a printer carbon ribbon, since the carbon ribbon feed shaft is applied with a rotational force acting in the reverse direction to that for feeding the carbon ribbon both during normal printing operation and during retraction of the printable medium, the carbon ribbon is subjected to a constant braking action as it is paid out, whereby slacking of the carbon ribbon can be positively prevented.

Other features and advantages of the present invention will become apparent from the following description of the invention which refers to the accompanying drawings.

DETAILED DESCRIPTION OF THE INVENTION

Figure 3:
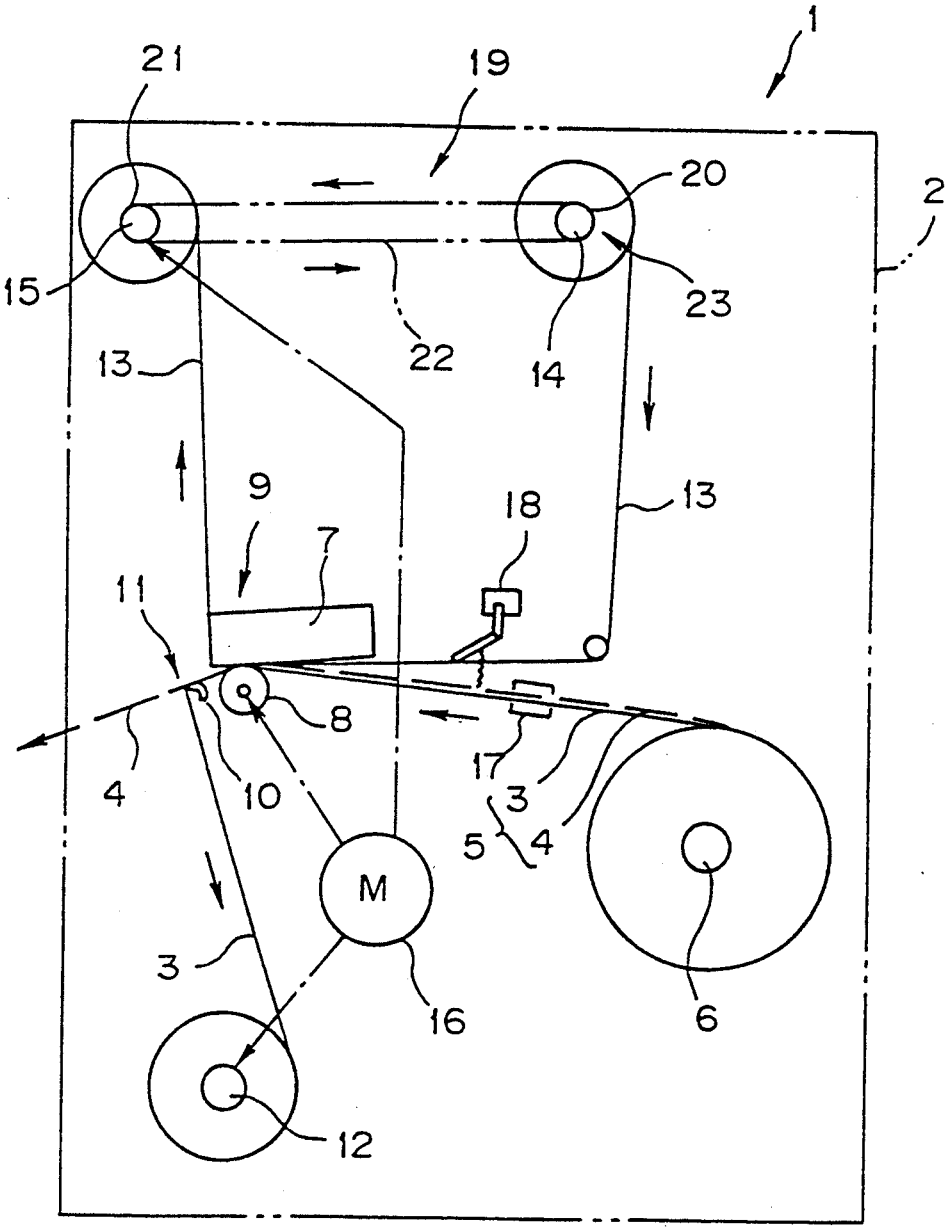
FIG. 3 is an overall schematic view of an ordinary conventional printer.
Figure 4:
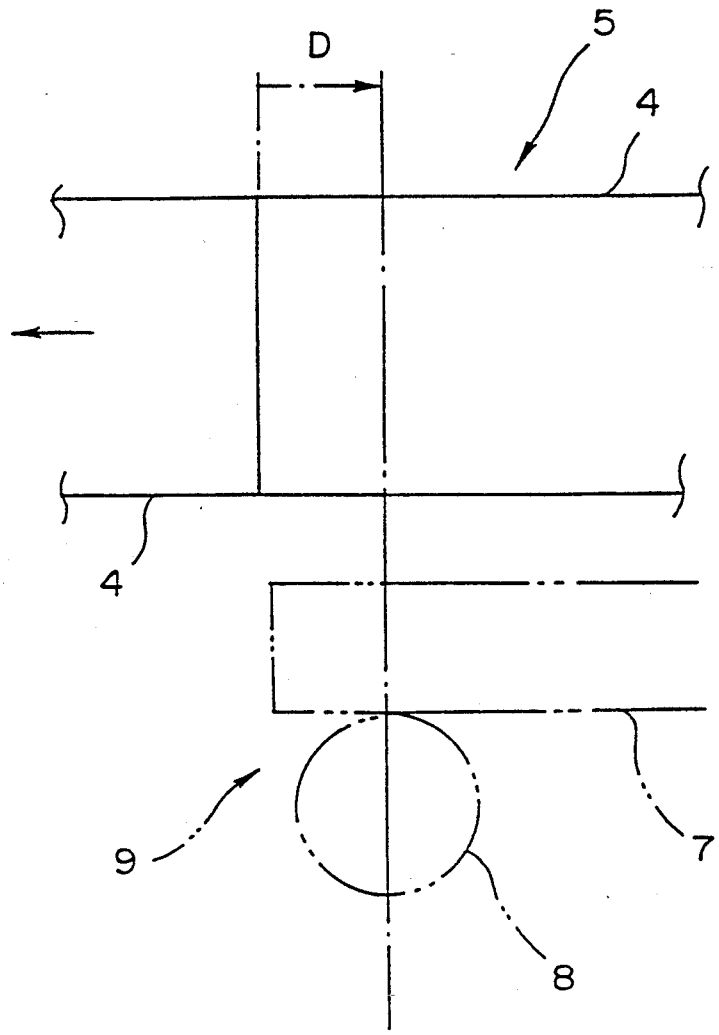
FIG. 4 is a plan view for explaining a label strip retracting operation.

An embodiment of the mechanism for preventing slack in a printer carbon ribbon will now be explained with reference to FIGS. 1 and 2. The members shown in these figures which are the same as those in FIGS. 3 and 4 are assigned like reference numbers to those in FIGS. 3 and 4 and will not be explained further.

Figure 1:
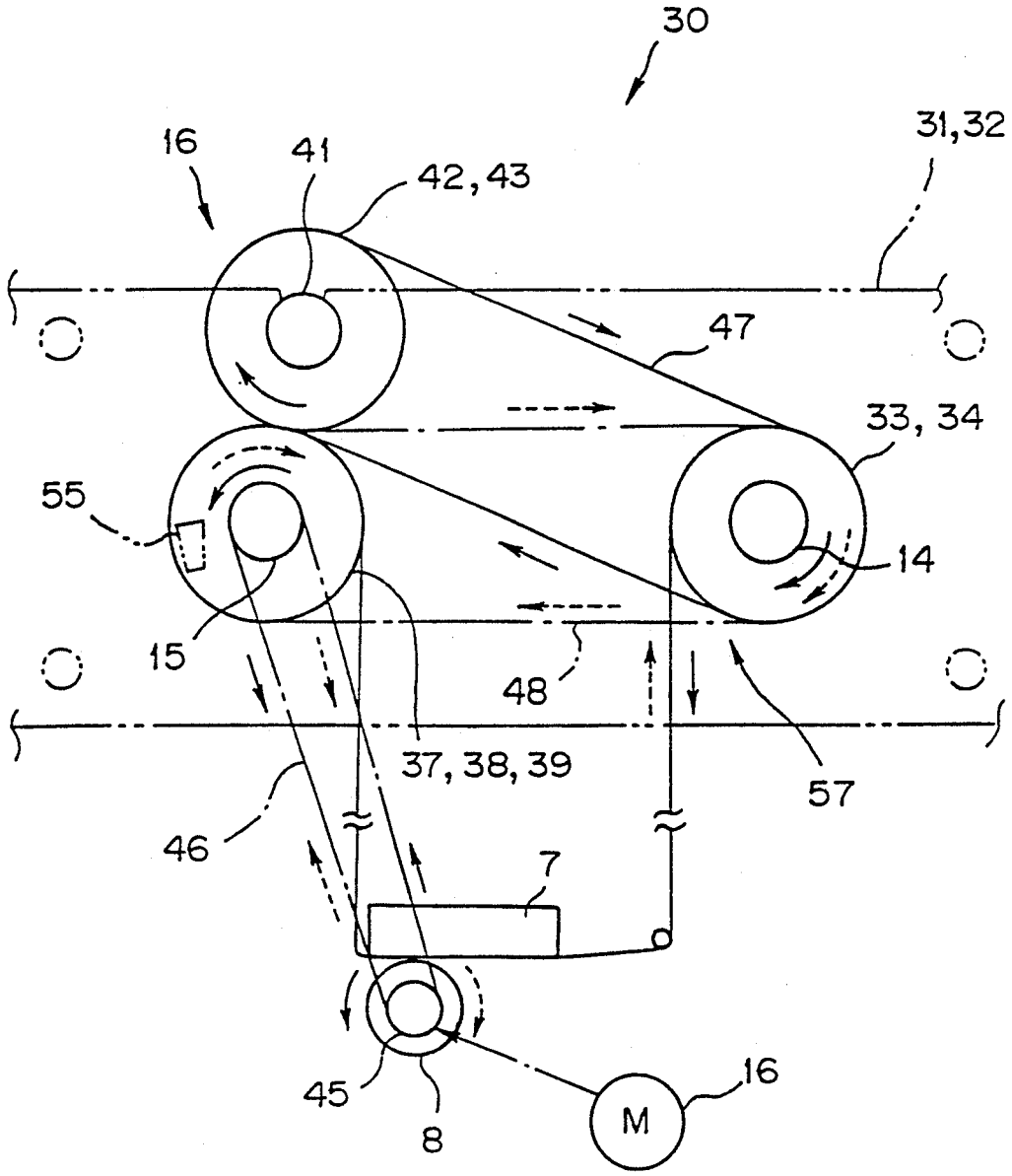
FIG. 1 is a side view of a mechanism for preventing slack in a printer carbon ribbon, which is an embodiment of the invention.
Figure 2:
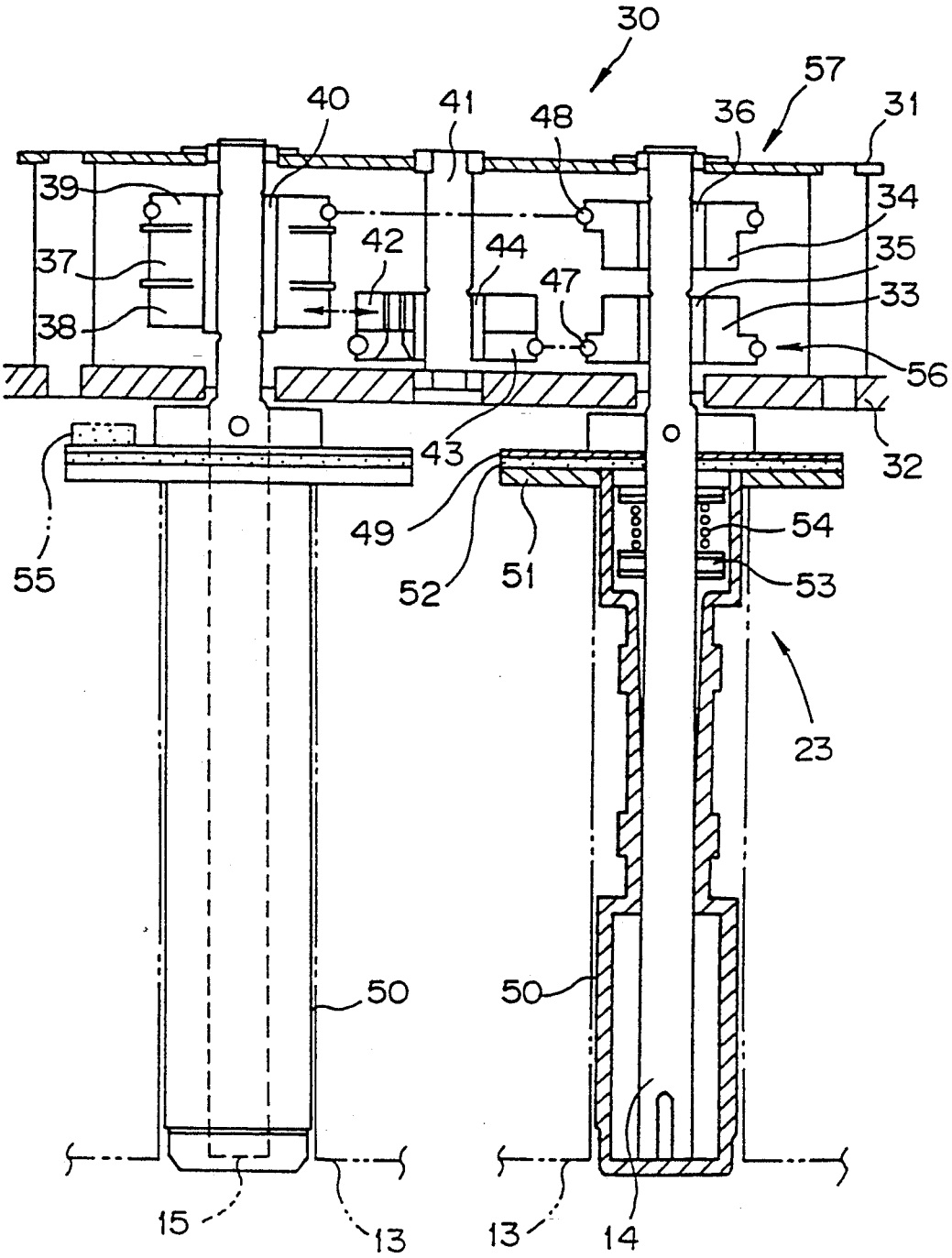
FIG. 2 is a plan view of the mechanism of FIG. 1.

In the mechanism for preventing slack in a printer carbon ribbon 13 designated by reference numeral 30 in FIGS. 1 and 2, the carbon ribbon feed shaft 14 and the carbon ribbon take-up shaft 15 are shown disposed closer together than in an actual printer. This is for convenience in depicting the mechanism on a single sheet of drawing paper.

The slack prevention mechanism 30 is located between a pair of support plates 31, 32 between which the carbon ribbon feed shaft 14, the carbon ribbon take-up shaft 15 and an intermediate shaft 41, to be explained later, are rotatably supported.

A first feed-side pulley 33 and a second feed-side pulley 34 are mounted on the carbon ribbon feed shaft 14.

A first feed-side one-way clutch 35 is provided between the first feed-side pulley 33 and the carbon ribbon feed shaft 14, and a second feed-side one-way clutch 36 is provided between the second feed-side pulley 34 and the carbon ribbon feed shaft 14.

During take-up of the carbon ribbon 13 on the carbon ribbon take-up shaft 15, i.e. during ordinary printing operation, the first feed-side one-way clutch 35 transmits the rotational force of the first feed-side pulley 33 to the carbon ribbon feed shaft 14, while during label strip 5 retraction operation, it does not transmit rotational force of the first feed-side pulley 33 to the carbon ribbon feed shaft 14 but leaves the carbon ribbon feed shaft 14 free to rotate.

During take-up of the carbon ribbon 13 on the carbon ribbon take-up shaft 15, i.e. during ordinary printing operation, the second feed-side one-way clutch 36 does not transmit rotational force of the second feed-side pulley 34 to the carbon ribbon feed shaft 14 but leaves the carbon ribbon feed shaft 14 free to rotate, while during retraction of the label strip 5, it transmits the rotational force of the second feed-side pulley 34 to the carbon ribbon feed shaft 14.

A first take-up side gear or pulley 37, a second take-up side gear 38 and a take-up side pulley 39 are mounted on the carbon ribbon take-up shaft 15.

The first take-up side gear 37, second take-up side gear 38 and take-up side pulley 39 rotate integrally. A take-up side one-way clutch 40 is provided between these members and the carbon ribbon take-up shaft 15.

During take-up of the carbon ribbon 13 on the carbon ribbon take-up shaft 15, i.e, during ordinary printing operation, the take-up side one-way clutch 40 transmits the rotational force of the first take-up side gear or pulley 37 to the carbon ribbon take-up shaft 15, while during label strip 5 retraction operation, it does not transmit rotational force to the take-up shaft 15 from the take-up side gear or pulley 37, the second take-up side gear 38 and the take-up side pulley 39 but leaves the gears 37 and 38 and pulley 39 free to rotate with respect to shaft 15.

The slack prevention mechanism 30 according to the present invention is provided with an intermediate shaft 41, in addition to the carbon ribbon feed shaft 14 and the carbon ribbon take-up shaft 15.

An intermediate gear 42 and an intermediate pulley 43 preferably integral with the intermediate gear 42 are mounted on the intermediate shaft 41.

An intermediate shaft one-way clutch 44 is provided between the intermediate shaft 41 and both the intermediate gear 42 and the intermediate pulley 43.

If the intermediate pulley 43 is arranged to rotate integrally with the carbon ribbon take-up shaft 15, it suffices for the intermediate shaft one-way clutch 44 to be provided only between the intermediate gear 42 and the intermediate shaft 41. If the intermediate pulley 43 is arranged to rotate integrally with the carbon ribbon take-up shaft 15, the second take-up side gear 38 is not arranged to rotate with the intermediate gear 42. The intermediate shaft one-way clutch 44 is provided between the intermediate gear 42 and the intermediate shaft 41 or between the intermediate pulley 43 and the intermediate shaft 41 or between the intermediate shaft 41 and the intermediate gear 42 to the intermediate pulley 43.

During take-up of the carbon ribbon 13 on the carbon ribbon take-up shaft 15, i.e. during ordinary printing operation, the intermediate shaft one-way clutch 44 transmits the rotational force of the intermediate gear 42 (and the intermediate pulley 43) to the intermediate shaft 41, while during label strip 5 retraction operation, it does not transmit rotational force to the intermediate shaft 41 but leaves the intermediate shaft 41 free to rotate.

In FIG. 2, the intermediate gear 42 of the intermediate shaft 41 and the second take-up side gear 38 of the carbon ribbon take-up shaft 15 are shown as being separated from each other. This is only for easier understanding of the drawing, however, and the two gears are in fact engaged for transmitting the rotational force of the second take-up side gear 38 to the intermediate gear 42.

As shown best in FIG. 1, a timing belt 46 is wound around the first take-up side gear 37 of the carbon ribbon take-up shaft 15 and a gear 45 of the platen 8.

Further, a first round belt 47 is wound around the intermediate pulley 43 and the first feed-side pulley 33, and a second round belt 48 is wound around the take-up side pulley 39 and the second feed-side pulley 34.

As shown best in FIG. 2, the slip mechanism 23 comprises a shaft flange 49 integral with the carbon ribbon feed shaft 14 at a position outside the support plate 31, a shaft cover 50 enclosing the end of the carbon ribbon feed shaft 14 outward of the shaft flange 49, a shaft cover flange 51 integral with the inner end of the shaft cover 50, a felt slip pad 52 disposed between the shaft flange 49 and the shaft cover 50, a spring seat 53 fixed on the carbon ribbon feed shaft 14 and a pressure spring 54.

A roll of carbon ribbon 13 is fitted on the shaft cover 50.

Although not shown in detail in the figures, the carbon ribbon take-up shaft 15 is provided with a slip mechanism similar to that of the carbon ribbon feed shaft 14.

The shaft flange 49 of the carbon ribbon take-up shaft 15 is preferably provided with a felt pad 55 for preventing inertial rotation.

In this embodiment, the first take-up side gear 37 and second take-up side gear 38 on the carbon ribbon take-up shaft 15, the intermediate gear 42 on the intermediate shaft 41, the intermediate pulley 43, the first round belt 47 and the first feed-side pulley 33 on the carbon ribbon feed shaft 14 together constitute a first reverse rotation sub-mechanism 56 for, during ordinary printing operation, applying a rotational force to the carbon ribbon feed shaft 14 in the reverse direction from that for feeding the carbon ribbon 13.

On the other hand, the first take-up side gear 37 and take-up side pulley 39 on the carbon ribbon take-up shaft 15, the second round belt 48 and the second feed-side pulley 34 together constitute a second reverse rotation sub-mechanism 57 for, during retraction of the printable medium (the label strip 5) in the reverse direction from that in which it is fed during printing, applying a rotational force to the carbon ribbon feed shaft 14 in the reverse direction from that for feeding the carbon ribbon 13.

In the described slack prevention mechanism 30, during normal printing operation, the drive motor 16 rotates the platen 8 in the counterclockwise direction in FIG. 1 for feeding the label strip 5 toward the platen 8. (The directions in which members are rotated and driven during ordinary printing are indicated by solid line arrows in FIG. 1.)

As the label strip 5 is being fed in this way, prescribed printing pulses are applied to the thermal printing head 7 for printing the labels 4.

For enabling printing, carbon ribbon 13 is paid out from the carbon ribbon feed shaft 14.

More specifically, the rotation of the platen 8 is transmitted to the first take-up side gear 37 on the carbon ribbon take-up shaft 15 by the timing belt 46 and the take-up side one-way clutch 40 transmits the rotation to the carbon ribbon take-up shaft 15 to rotate it counterclockwise in FIG. 1. The resulting take-up of carbon ribbon 13 on the carbon ribbon take-up shaft 15 causes the carbon ribbon 13 to be paid out by the carbon ribbon feed shaft 14.

During the time that the carbon ribbon 13 is being paid out from the carbon ribbon feed shaft 14, the rotation of the first take-up side gear 37 is transmitted through the second take-up side gear 38 to the intermediate gear 42 and the intermediate pulley 43 on the intermediate shaft 41, causing the intermediate shaft one-way clutch 44 to rotate the intermediate shaft 41. As a result, the rotation is transmitted through the intermediate pulley 43 and the first round belt 47 to the first feed side pulley 33 on the carbon ribbon feed shaft 14 and from here through the first feed-side one-way clutch 35 to the carbon ribbon feed shaft 14, thus applying to the carbon ribbon feed shaft 14 a rotational force in the reverse direction from that for feeding the carbon ribbon 13.

Since the carbon ribbon feed shaft 14 is equipped with the slip mechanism 23 consisting of the felt slip pad 52 etc., the carbon ribbon 13 can be drawn off toward the carbon ribbon take-up shaft 15 owing to the slippage of the carbon ribbon feed shaft 14, more precisely the shaft cover 50. The carbon ribbon 13 is thus paid out while being subjected to a back tension.

Since the first reverse rotation sub-mechanism 56 applies a rotational force to the carbon ribbon feed shaft 14 in the reverse direction from that for paying out the carbon ribbon 13, the carbon ribbon 13 is prevented from developing slack or snaking during ordinary printing operation.

During the aforesaid operation of the first reverse rotation sub-mechanism 56, the second reverse rotation sub-mechanism 57 is substantially inactivated because rotational force transmitted through the take-up side pulley 39, the second round belt 48 and the second feed-side pulley 34 is not transmitted to the carbon ribbon feed shaft 14 through the second feed-side one-way clutch 36.

After the printing of one label 4 has been completed, the platen 8 is rotated in reverse for retracting the next label 4 by a given amount (the distance D in FIG. 4). (The directions in which members are rotated and driven during retraction operation are indicated by broken line arrows in FIG. 1.)

This reverse rotation causes the label strip 5 to move back to the position shown in FIG. 4. At the same time, however, the timing belt 46 reversely rotates the first take-up side gear 37 on the carbon ribbon take-up shaft 15 (causing gear 37 to rotate clockwise in FIG. 1).

The reverse rotation of the first take-up side gear 37 is transmitted to the integrally formed take-up side pulley 39 and then through the second round belt 48 to rotate the second feed-side pulley 34.

Since the second feed-side one-way clutch 36 associated with the second feed-side pulley 34 is able to transmit driving force when rotated in this direction, the carbon ribbon feed shaft 14 receives this driving force and is caused to rotate in the reverse direction from that for paying out the carbon ribbon 13. As a result, the excess portion of the carbon ribbon 13 resulting from the retraction of the label strip 5 is wound back onto the carbon ribbon feed shaft 14. The second reverse rotation sub-mechanism 57 thus prevents slacking or snaking of the carbon ribbon 13.

The dimensions etc. of the members of the second reverse rotation sub-mechanism 57 are of course selected such that there can be secured a sufficient amount of rotation of the carbon ribbon feed shaft 14 for absorbing the slack in the carbon ribbon 13 and also maintaining a prescribed amount of tension therein.

In the first reverse rotation sub-mechanism 56, on the other hand, while the reverse rotational force is transmitted from the second take-up side gear 38 to the intermediate gear 42 and the intermediate pulley 43, it is not transmitted to the intermediate shaft 41 because the intermediate shaft one-way clutch 44 allows the intermediate gear 42 and the intermediate pulley 43 to rotate freely at this time. As a result, the reverse rotational force from the intermediate pulley 43 is transmitted through the first round belt 47 to the first feed-side pulley 33 on the carbon ribbon feed shaft 14.

However, the first feed-side one-way clutch 35 associated with the first feed-side pulley 33 on the carbon ribbon feed shaft 14 allows the first feed-side pulley 33 to rotate freely, and this prevents the transmission of a drive force from the intermediate shaft 41 to the carbon ribbon feed shaft 14. The substantial inactivation of the first reverse rotation sub-mechanism 56 is thus ensured.

Even after the feed direction of the label strip 5 has been switched from normal to reverse, the carbon ribbon take-up shaft 15 tends to continue to rotate in the normal direction owing to its inertia. In this invention, however, this is prevented by the felt pad 55 held in pressure contact with the shaft flange 49 of the carbon ribbon take-up shaft 15.

Thus, briefly stated, the carbon ribbon feed shaft 14 is provided with a rotational force in the reverse direction from that for feeding the carbon ribbon 3 by the first reverse rotation sub-mechanism 56 during ordinary printing and by the second reverse rotation sub-mechanism 57 during retraction of the label strip 5.

Irrespective of the direction of rotation of the carbon ribbon take-up shaft 15, therefore, the carbon ribbon feed shaft 14 is constantly biased to rotate in the reverse direction from that for feeding the carbon ribbon 13. At the same time, however, the slip mechanism 23 enables the carbon ribbon feed shaft 14 to pay out the carbon ribbon 13 while subjecting it to back tension. As a result, the slack prevention mechanism 30 positively prevents slacking and snaking of the carbon ribbon 13.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A mechanism for preventing slack in a printer carbon ribbon wherein a carbon ribbon feed shaft is always provided with a rotational force acting in reverse direction to a carbon ribbon feed direction irrespective of the direction of rotation of a carbon ribbon take-up shaft, the mechanism comprising:

a printing mechanism for printing characters on a printable medium as the printable medium is fed thereto;

a carbon ribbon feed shaft for feeding a carbon ribbon to enable the printing on the printable medium;

a carbon ribbon take-up shaft for taking up the carbon ribbon;

a slip mechanism provided on the carbon ribbon feed shaft; and a reverse rotation mechanism for applying a rotational force to the carbon ribbon feed shaft in a reverse direction from that for feeding the carbon ribbon, the reverse rotation mechanism having a first reverse rotation sub-mechanism for applying a rotational force to the carbon ribbon feed shaft in the reverse direction from that for feeding the carbon ribbon when the printable medium is being fed in the forward direction and a second reverse rotation sub-mechanism for applying a rotational force to the carbon ribbon feed shaft in the reverse direction from that for feeding the carbon ribbon when the printable medium is being retracted in the reverse direction;

the first reverse rotation sub-mechanism comprising a first drive means disposed on said carbon ribbon take-up shaft and driving said take-up shaft through a first one-way clutch, and further comprising an intermediate means, the first drive means driving the intermediate means, said intermediate means driving a first belt member, said first belt member being coupled to said carbon-ribbon feed shaft through a second one-way clutch, whereby when said first drive means rotates in a first direction so as to take up carbon ribbon on said take-up shaft, said first one-way clutch drives said take-up shaft to take-up carbon ribbon and said intermediate means drives said carbon-ribbon feed shaft through said second one-way clutch in a direction opposite to the direction for feeding carbon ribbon from said feed shaft to prevent slack in said carbon ribbon, and when said first drive means rotates in a second direction opposite said first direction, said first one-way clutch does not drive said take-up shaft and said second one-way clutch does not drive said feed shaft;

said second reverse rotation sub-mechanism comprising said first drive means driving a second belt member, said second belt member coupled to said carbon-ribbon feed shaft through a third one-way clutch, whereby when said first drive means rotates in the first direction so as to drive said take-up feed shaft to take-up carbon ribbon, said third clutch prevents driving of said feed shaft by said second belt member, and when said first drive means rotates in the second direction opposite to the first direction, said third clutch drives said feed shaft in a direction opposite to the direction for feeding carbon ribbon.

2. The mechanism for preventing slack in a printer carbon ribbon as recited in claim 1, further comprising a fourth one-way clutch, said intermediate means comprising an intermediate shaft and a second drive means disposed on said intermediate shaft, said intermediate shaft being driven by said second drive means through said fourth one-way clutch, said second drive means being driven by said first drive means, said second drive means driving said first belt member.

3. The mechanism for preventing slack in a printer carbon ribbon as recited in claim 1, further comprising:

a drive motor;

a platen adjacent a printing head of said printing mechanism, the platen being rotatable by the drive motor; and a third belt member being driven by said platen, the third belt member being coupled to said first drive means for rotating said take-up shaft through said first one-way clutch.

4. The mechanism for preventing slack in a printer carbon ribbon as recited in claim 1, wherein the printing mechanism comprises a thermal printer.

5. The mechanism for preventing slack in a printer carbon ribbon as recited in claim 1, wherein:

a first pulley is provided on said intermediate means coupled to said first one-way clutch for engaging said first belt member, a second pulley is provided on said feed shaft coupled to said second one-way clutch for engaging said first belt member;

a third pulley is provided on said take-up shaft coupled to said first one-way clutch for engaging said second belt member and a fourth pulley is provided on said feed shaft coupled to said third one-way clutch for engaging said second belt member; and said first drive means comprising a first gear, said intermediate means having a second gear in arrangement with said first gear.

6. A mechanism for preventing slack in a printer ribbon in a printer which prints characters on a printable medium, the printable medium moving both in a forward printable medium direction and a reverse printable medium direction, and wherein a drive motor is used both to move the printable medium and to take-up the printer ribbon, the mechanism comprising:

a printer ribbon feed shaft for feeding a printer ribbon to enable the printing on the printable medium;

a printer ribbon take-up shaft for taking up the printer ribbon;

a slip mechanism provided on the printer ribbon feed shaft; and a reverse rotation mechanism for applying a rotational force to the printer ribbon feed shaft in the reverse direction from that for feeding the printer ribbon, both when the printable medium is being fed in the forward printable medium direction and in the reverse printable medium direction, the reverse rotation mechanism having a first reverse rotation sub-mechanism for applying a rotational force to the printer ribbon feed shaft in the reverse direction from that for feeding the printer ribbon when the printable medium is being fed in the forward printable medium direction and a second reverse rotation sub-mechanism for applying a rotational force to the printer ribbon feed shaft in the reverse direction from that for feeding the carbon ribbon when the printable medium is being retracted in the reverse printable medium direction.

7. The mechanism for preventing slack in a printer carbon ribbon as recited in claim 6, wherein the first reverse rotation sub-mechanism comprises a first drive means disposed on said printer ribbon take-up shaft and driving said take-up shaft through a first one-way clutch, and further comprising an intermediate means, the first drive means driving the intermediate means, said intermediate means driving a first belt member, said first belt member being coupled to said printer ribbon feed shaft through a second one-way clutch, whereby when said first drive means rotates in a first direction so as to take up printer ribbon on said take-up shaft, said first one-way clutch drives said take-up shaft to take-up printer ribbon and said intermediate means drives said printer ribbon feed shaft through said second one-way clutch in a direction opposite to the direction for feeding printer ribbon from said feed shaft to prevent slack in said printer ribbon, and when said first drive means rotates in a second direction opposite the first direction, said first one-way clutch does not drive said take-up shaft and said second one-way clutch does not drive said feed shaft;

said second reverse rotation sub-mechanism comprising said first drive means driving a second belt member, said second belt member coupled to said printer ribbon feed shaft through a third one-way clutch, whereby when said first drive means rotates in the first direction so as to drive said take-up feed shaft to take-up printer ribbon, said third clutch prevents driving of said feed shaft by said second belt member, and when said first drive means rotates in the second direction opposite the first direction, said third clutch drives said feed shaft in a direction opposite to the direction for feeding carbon ribbon.

8. The mechanism for preventing slack in a printer ribbon as recited in claim 7, further comprising a fourth one-way clutch, said intermediate means comprising an intermediate shaft and a second drive means disposed on said intermediate shaft, said intermediate shaft being driven by said second means through said fourth one-way clutch, said second drive means being driven by said first drive means, said second drive means driving said first belt member.

9. The mechanism for preventing slack in a printer ribbon as recited in claim 7, further comprising:

a platen adjacent a printing head, the platen being rotatable by the drive motor; and a third belt member being driven by said platen, the third belt member being coupled to said first drive means for rotating said take-up shaft through said first one-way clutch.

10. The mechanism for preventing slack in a printer ribbon as recited in claim 6, wherein the printer comprises a thermal printer.

11. The mechanism for preventing slack in a printer ribbon as recited in claim 7, wherein:

a first pulley is provided on said intermediate means coupled to said first one-way clutch for engaging said first belt member, a second pulley is provided on said feed shaft coupled to said second one-way clutch for engaging said first belt member;

a third pulley is provided on said take-up shaft coupled to said first one-way clutch for engaging said second belt and a fourth pulley is provided on said feed shaft coupled to said third one-way clutch for engaging said second belt member; and said first drive means comprising a first gear, said intermediate means having a second gear in engagement with said first gear.

* * * * *